United States Patent [19]

Gilbert, Jr.

[11] 3,932,020

[45] Jan. 13, 1976

[54] ELECTRICAL CONNECTORS

[75] Inventor: Robert L. Gilbert, Jr., Warren, Mich.

[73] Assignee: The United States of America as represented by the Secretary of the Army, Washington, D.C.

[22] Filed: Mar. 29, 1974

[21] Appl. No.: 456,407

[52] U.S. Cl. ..... 339/177 R
[51] Int. Cl.[2] ..... H01R 17/06
[58] Field of Search ..... 339/177 R, 177 E

[56] References Cited

UNITED STATES PATENTS

| | | | |
|---|---|---|---|
| 1,026,238 | 5/1912 | Andersen | 339/177 E |
| 2,723,380 | 11/1955 | Howard | 339/177 R |
| 2,869,090 | 1/1959 | Johanson | 339/177 E |
| 3,230,499 | 1/1966 | Haegert | 339/268 R |

FOREIGN PATENTS OR APPLICATIONS

| | | | |
|---|---|---|---|
| 676,918 | 8/1952 | United Kingdom | 339/177 E |

*Primary Examiner*—Roy Lake
*Assistant Examiner*—Neil Abrams
*Attorney, Agent, or Firm*—Peter A. Taucher; John E. McRae; Robert P. Gibson

[57] ABSTRACT

There is disclosed a slide-on type of electrical connector having two separated concentric contact elements encapsulated within a dielectric mounting material. Each contact element includes a slide contact at one of its ends and a post-type terminal at its other end. The respective slide-on contacts are concentrically arranged, one within the other, for completing two separate circuits when the connector is telescoped onto a mating connector device. Each of the contact elements has a large contact surface and a large effective cross section along its entire length for enabling the connector element to carry large currents in excess of 200 amperes. Each contact element is preferably formed as a one piece metal casting.

1 Claim, 10 Drawing Figures

50
64
52
62
6
6
44
42
40
59
5
5
46
58
54
48
32
56
22
4
4
28
23
10
14
29
12
30
32
30
34
32
1
1
27
28
23
18
25

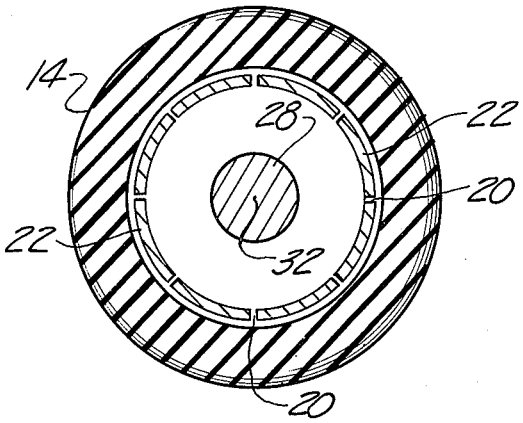
Fig-4
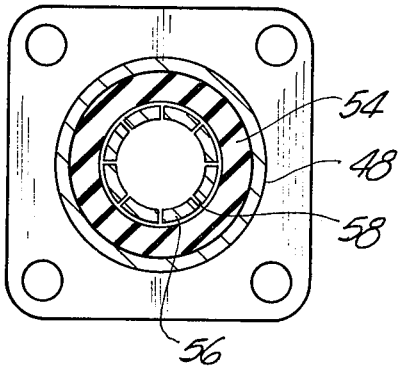
Fig-5
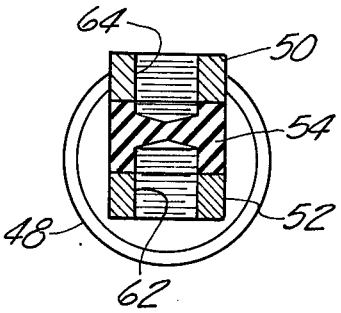
Fig-6
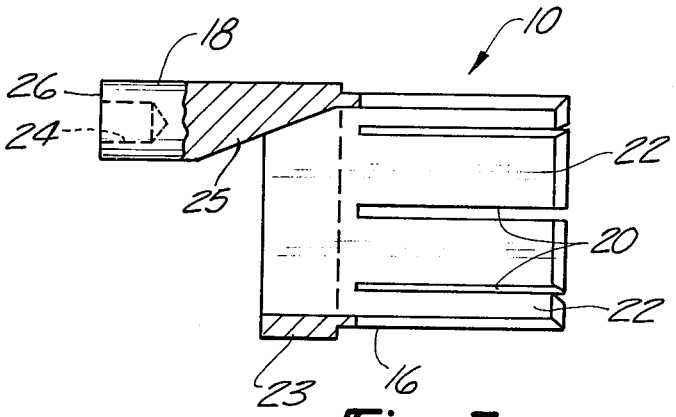
Fig-7
Fig-8
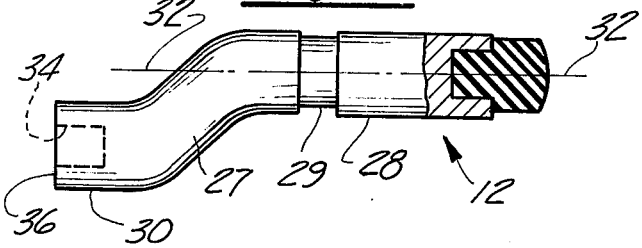
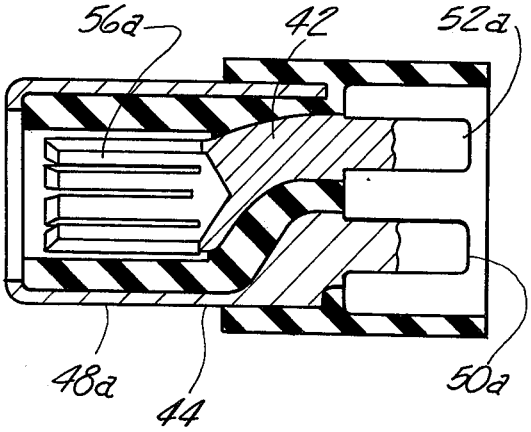
Fig-9
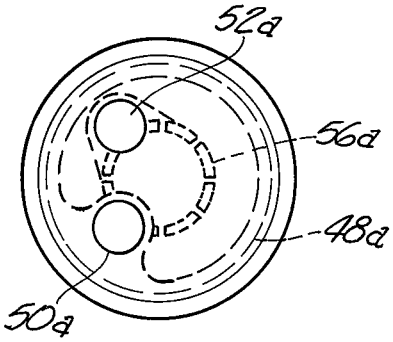
Fig-10

ELECTRICAL CONNECTORS

BACKGROUND OF THE INVENTION

Certain Military vehicles are equipped with cable devices for temporarily enabling a charged battery in one of the vehicles to energize a starter motor in the other vehicle, as for example when the other vehicle's battery has been permitted to run down. The cable device commonly is provided with slide-on type electrical connectors at each of its ends. In use of the cable each electrical connector is plugged onto a mating receptacle in one of the vehicles. Each cable includes two insulated conductors, i.e. a positive conductor and a negative conductor; accordingly each connector includes two separate contact elements for connecting the ends of the conductors to the fixed contacts in the vehicle receptacle.

The present invention relates to an improved connector design that can be used, either at the end of the cable or in the vehicle receptacle, to simultaneously complete the positive and negative circuits. The connector design contemplates two concentric metallic connector elements economically encapsulated as inserts in a molded dielectric block.

THE DRAWINGS

Figures 1, 2, 3:
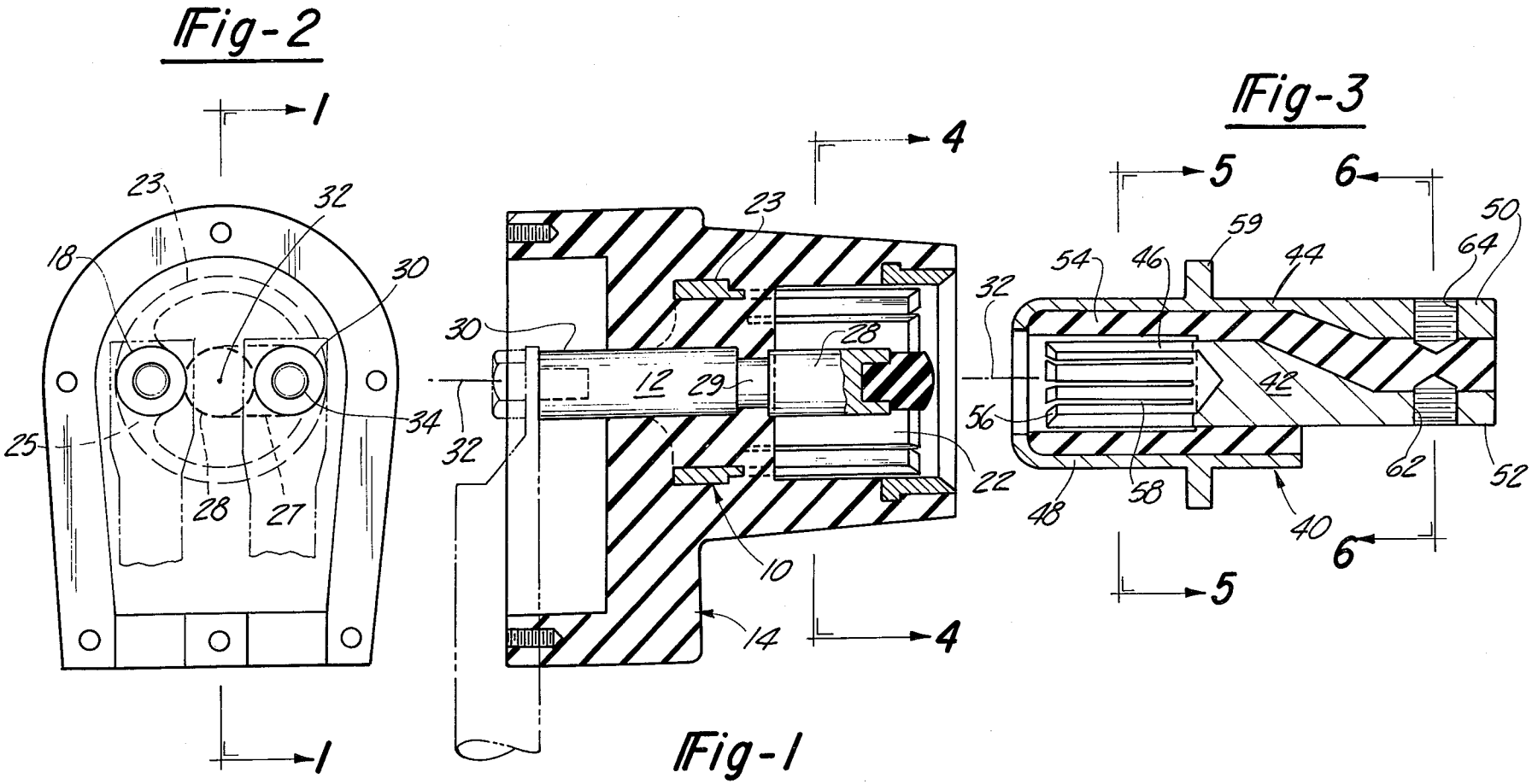
FIG. 1 is a sectional view through a connector assembly embodying the invention.
FIG. 2 is a left end view of the FIG. 1 connector assembly.
FIG. 3 is a sectional view through a second connector assembly using the invention. This assembly is adapted to slidably mate with the FIG. 1 device to form a connection between the cable and the vehicle.

FIGS. 4, 5 and 6 are sectional views taken on lines 4—4, 5—5 and 6—6 in FIGS. 1 and 3.

FIGS. 7 and 8 illustrate components used in the FIG. 1 assembly.

FIGS. 9 and 10 are sectional views through an "adapter" device designed according to the invention for adapting the FIG. 1 device to use with vehicles having socket-type receptacles that would otherwise be unable to mate with the FIG. 1 device.

FIG. 1 shows an electrical connector assembly comprising two metallic conductive elements 10 and 12 encapsulated within a dielectric molding 14. As best seen in FIG. 7, element 10 is a one piece cast structure, comprising a main body portion 16 of annular configuration, and a post-like extension 18. Annular portion 16 is machined to provide eight axial slits 20 that define eight cantilever arms 22 (four of which are visible in FIG. 7). The leftmost area 23 of main body portion 16 provides an uninterrupted ring-like annulus that serves to electrically and mechanically connect arms 22 with post 18. Post 18 is provided with a threaded opening 24 in its end face 26 for reception of lead wire attachment screw, not shown in FIG. 7.

Metallic element 12, shown best in FIG. 8, is a one piece cast structure, comprising a main body portion 28 of pin-like configuration, and a post-like extension 30 offset from the central axis 32 defined by body portion 28. Extension 30 is provided with a threaded opening 34 in its end face 36 for reception of a lead wire attachment screw, not visible in FIG. 8.

Metallic elements 10 and 12 are anchored in concentric spaced relation by means of the dielectric encapsulating material 14, shown best in FIG. 1. The dielectric entirely surrounds and embeds ring portion 23 of member 10 and the reduced diameter portion 29 of member 12. As seen in FIG. 4, the conductive elements are concentrically arranged, one within the other, about the central axis 32. The post-like extensions 18 and 30 are offset from central axis 32, as best seen in FIG. 2.

FIGS. 2, 7 and 8 collectively show the changes or transitions in wall configuration that take place between the post-like extensions and the main body portions of the respective conductive elements. Post 18 is located generally in alignment with a point on the circumference of annulus 23. The intervening transition wall 25 gradually widens in the circumferential direction and narrows in the radial direction to effect a merger of annulus 23 with post 18; the gradual transition provides satisfactory wall thickness without permitting element 10 to come in dangerously close proximity to element 12.

Post 30 is spaced a sufficient distance away from post 18 due to the "offset" transition 27 between main body portion 28 and post portion 30. Elements 10 and 12 are oriented so that post 30 is diammetrically across from post 18, as shown in FIG. 2. FIGS. 1 and 2 show in phantom cable lead wires attached to the posts by means of screws threaded into the openings in the post end faces. A cover (not shown) can be secured on the left face of dielectric body 14 to shield the cable-connector joints from the weather.

FIG. 3 illustrates a vehicle-mounted receptacle 40 that can be used with the FIG. 1 connector. Receptacle 40 comprises two concentric spaced conductive elements 42 and 44, each having a main body 46 or 48 and a post-like extension 50 or 52. Elements 42 and 44 are one piece metal castings encapsulated within a dielectric molding 54.

Main body portion 46 of element 42 comprises a series of cantilever arms 56 formed by circumferentially spaced slits 58 (FIG. 5). The diameter of the space circumscribed by arms 56 corresponds to the diameter of plug portion 28 of element 12; accordingly the FIG. 1 connector may be slidably plugged onto the FIG. 3 receptacle to complete a circuit across conductive elements 12 and 42. Post-like extension 52 of element 42 has a threaded opening 62 in its side face for reception of lead wire attachment screw (not shown) located within the vehicle.

The aforementioned conductive element 44 comprises a main body portion 48 of cylindrical sleeve-like configuration. Intermediate its ends the main body portion is provided with a flange 59 that can be used to bolt receptacle 40 to the vehicle; the flange also acts as a grounding connection for the circuit that connects to conductive element 44. The outer diameter of sleeve portion 48 corresponds to the diameter of the space circumscribed by cantilever arms 22; accordingly when the FIG. 1 connector is plugged onto the FIG. 3 receptacle a circuit is completed across arms 22 and sleeve portion 48. The threaded opening 64 in the side face of the conductive post portion 50 is adapted to receive an attachment screw for the vehicle wiring.

The FIG. 1 connector and FIG. 3 connector slidably mate together to complete two separate circuits. A positive circuit may be completed across conductive element portions 28 and 56. A negative circuit may be completed across conductive element portions 22 and 48.

FIGS. 9 and 10 illustrate an "adapter" type connector that can be used between the FIG. 1 cable termination and a vehicle receptacle of the multi-socket type (not shown). The adapter is generally similar to the FIG. 3 connector except that post-like extensions 50*a* and 52*a* are cylindrical for reception in circular sockets in the non-illustrated vehicle receptacle. The adapter is a loose item of hardware not necessarily intended for permanent mounting in the vehicle; hence it does not have a mounting flange corresponding to flange 59 of the FIG. 3 device. The concentric portions 48a and 56a of the adapter are adapted to slidably interengage with portions 28 and 22 of the FIG. 1 cable termination such that extensions 50*a* and 52*a* are exposed to plug into the receptacle sockets.

FEATURES OF THE INVENTION

The principal feature of the invention, as exemplified in the embodiments of FIGS. 1, 3 and 9, is the relative simplicity of the connector design wherein the spaced concentric conductor elements (10, 12 or 42, 44) are accurately anchored within a dielectric molding as part of the molding operation.

Each of the conductor elements is a one piece casting of substantial contact area and substantial wall thickness along its entire length. For example, element 10 shown in FIG. 7 has cantilever arms 22 of substantial radial thickness (measured from central axis 32) and substantial inner surface area; these factors provide good current carrying abilities and low contact resistance. The inner surfaces of arms 22 can be accurately machined to the diameter of mating sleeve 48 to provide the desired contact surfaces. One or both of the mating surfaces can be slightly tapered to ensure good electrical contact along the length of each arm 22 and also good frictional locking of the arms on the surface of sleeve 48. Arms 22 act as stiff springs to exert clamping forces on sleeve 48. It will be understood that the cantilever arms used in the embodiments of FIGS. 3 and 9 can be machined to proper taper to have desired gripping contact on the cooperating mechanisms.

The relatively thick arms 22 have an inherent stiffness that is not readily achieved with thinner arms formed by stamped sheet metal structures. Therefore assemblies using metal castings are well adapted for use in vehicles where the stiffness resists dislodgement of the mated connectors due to vibrational distrubances. Arms 56 used in the FIG. 3 and FIG. 9 embodiments have similar stiffness characteristics.

It will be noted that the concentric conductive elements are adapted to occupy relatively small space in relation to the element wall thickness and contact surface area. The post-like extensions (18, 30 or 50, 52 or 50*a*, 52*a*) are offset from the concentric portions of the conductive elements but still primarily within the diammetrical outline of the conductive slide-on structure; the post design therefore promotes miniaturization and materials economies.

The posts are in each case connected to the main body portion of the respective conductive elements by relatively thick transition walls that maintain wall thicknesses without bringing the two conductive elements dangerously close together. The posts themselves are in each case anchored and relatively widely spaced from one another for proper orientation to the vehicle or cable wiring.

The concentric nature of the conductive elements is such that the FIG. 1 connector assembly can be plugged onto the FIG. 3 or FIG. 9 receptacles in any rotated position. The cable can thus be swivelled or rotated to different positions in accordance with the relative positions of the two vehicles and/or the degree of accessibility of the receptacle in each vehicle.

I wish it to be understood that I do not desire to be limited to the exact details of construction shown and described, for obvious modifications will occur to a person skilled in the art.

I claim:

1. An electrical connector assembly comprising a first conductive element formed as a one piece metal casting; said casting including a main annular body portion having a first post-like extension off-set from but parallel to the body portion axis, the end area of the annular body portion remote from the post-like extension having a number of slits machined therein parallel to the body portion axis, said slits separating the end area of the annular body portion into an equivalent number of stiff resilient cantilever arms, said slits extending only part way along the axial dimension of the annular body portion whereby the unslit area of said body portion defines an uninterrupted ring-like annulus; said electrical connector assembly further comprising a second one piece conductive element having a pin-like body portion located on the axis of the aforementioned annular body portion and within the space circumscribed by the resilient cantilever arms; said second conductive element further including a second post-like extension off-set from but parallel to the body portion axis, and a transition portion integrally joining the pin-like body portion and the second post-like extension; said electrical connector assembly further comprising a dielectric body molded around selected portions of the first and second conductive elements to anchor them in spaced-apart relationship; said dielectric body comprising a central dielectric section surrounding and embedding therein the ring-like annulus area of the first element and the circumscribed portion of the second element; said dielectric body further comprising an annular shroud portion surrounding but spaced outwardly from the cantilever arms to permit limited deflection movements of said arms about their connections with the aforementioned ring-like annulus; the aforementioned post-like extensions projecting axially through the dielectric body to provide exposed post end faces, said post-like extensions having threaded openings in their exposed end faces for reception of lead wire-attachment screws; the aforementioned dielectric body having lead wire openings in its side surface so that the lead wires are enabled to extend into the dielectric body normal to the post-like extensions; the aforementioned conductive elements having circular contours taken around the aforementioned axis, thus permitting the defined electrical connector assembly to swivel around the aforementioned axis for accommodation of different lead wire directions; the post-like extensions being widely spaced on a diammetrical line passing through said axis.

* * * * *